United States Patent [19]

Garcia

[11] 4,033,640

[45] July 5, 1977

[54] SEAL BEARING APPARATUS

[75] Inventor: Juan A. Garcia, Houston, Tex.

[73] Assignee: Exxon Production Research Company, Houston, Tex.

[22] Filed: July 20, 1976

[21] Appl. No.: 707,132

Related U.S. Application Data

[62] Division of Ser. No. 562,691, March 27, 1975.

[52] U.S. Cl. ..... 308/4 A; 175/337

[51] Int. Cl.[2] ..... F16C 17/00

[58] Field of Search ..... 308/4 R, 4 A, 230, 122, 308/8.2; 175/337, 107; 166/241

[56] References Cited

UNITED STATES PATENTS

| | | | |
|---|---|---|---|
| 2,783,028 | 2/1957 | Jamison | 308/4 A X |
| 3,449,030 | 6/1969 | Tiraspolsky et al. | 308/230 |
| 3,982,859 | 9/1976 | Tschirky et al. | 308/4 A X |

*Primary Examiner*—Joseph F. Peters, Jr.
*Assistant Examiner*—Gene A. Church
*Attorney, Agent, or Firm*—John S. Schneider

[57] ABSTRACT

A liner hanger assembly and method of installation for use in oil and gas well operations having multiple individual hanger units arranged in series for even load distribution. Each individual hanger unit carries a proportional amount of the weight load of a suspended well pipe (casing liner) and has a balanced pressure, sealed bearing which facilitates rotation of the casing liner in the well bore during cementing operations.

6 Claims, 9 Drawing Figures

SEAL BEARING APPARATUS

This is a, division, of application Ser. No. 562,691, filed Mar. 27, 1975.

BACKGROUND OF THE INVENTION

1. Field of the Invention

This invention generally concerns an apparatus and method for hanging a casing liner in a borehole, and more specifically concerns a balanced load apparatus and method for hanging and rotating liners in a well bore during cementing operations.

2. The Prior Art

In oil and gas well operations after drilling the borehole, well pipe is run into the borehole and cemented in place. Basically, well pipe cementing operations are conducted as follows. Liner pipe is suspended in the borehole from hangers on existing well casing and extends to a point in close proximity with the borehole bottom. At the lower end of the liner pipe there is a cement shoe which typically has several orifices. The cement is introduced at the wellhead and passes through the liner to the cement shoe where it passes through the orifices into the borehole. As more cement is introduced, it is forced through the orifices in the shoe and up the well bore on the outside of the liner. As the cement is forced back up the well bore it displaces drilling mud. Generally, it is desirable during cementing operations to rotate and/or reciprocate the casing liner to ensure an even and thorough application of cement and proper displacement of the drilling mud. Rotation during cementing operations is practiced industry wide based upon tests showing 85% mud displacement with rotation and only 30% mud displacement without rotation. Currently, in order to rotate during cementing, the liner must remain attached to the drill string, which is suspended from the drilling rig at the surface, until the liner hanger is set and the drill pipe is released and pulled out of the wall. Once set the casing liner is suspended from the well casing by using a liner hanger and it is not permitted to rest on the bottom of the borehole. Suspension of the casing liner in this manner prevents fouling of the cement shoe orifice and prevents the liner from buckling or deforming under its own weight.

Successful utilization of the above described procedure requires precise performance of the drill string releasing mechanism and the setting of the liner hangers. If either the releasing mechanism or the hanger fails to perform properly the result can be very costly. To illustrate this, consider the results of failure of the liner hanger to set properly. In this situation, cementing operations are conducted while rotating the casing liner with the attached drill pipe. Once the cementing is complete, the hanger is set. However, if it fails to set properly it cannot be removed and reset since the cement is already in place. The same is true if the releasing mechanism fails to disengage the drill string, that is, the cement will prevent later removal of the drill string. The results are costly loss of well equipment or even junking of the well. To avoid this problem, most operators set the hanger and release the drill string from it prior to pumping the cement downhole. However, doing so prevents reciprocation or rotation during cementing operations since the drill string must be attached to the casing liner to rotate it. Hence, using this method would result in poor cementing operations.

Thereafter, to alleviate the problem of incapability of rotation once a hanger was set, new hangers were designed to include bearings. In this type of structure, the hanger was set with the casing liner suspended from it and all of the weight was supported by the rotational bearing. Thus, it was possible to cement and rotate after the hanger was set. Although this was a better system, there were still serious problems that resulted in failure. In very deep wells in which the weight of the suspended liner pipe was great, the bearings were subjected to a great deal of stress and would wear out rapidly. Further, these bearings were an open type and therefore were exposed to an extremely erosive well bore environment, i.e., drilling mud, sands, etc., which would also cause excessive wear. Further, with bearings that were open to the erosive well bore environment, it was necessary to lubricate and cool the bearing during its operation. A further problem encountered with the bearings on the prior art hangers was experienced when the well was drilled off center, that is, drilled at an angle from the vertical. Under these circumstances, heavy side pressure on the ball bearing raceway would cause it to crack and break.

Other techniques utilized to solve the weight suspension problems, such as utilizing telescoping liners with intermediate support at each juncture, have not always been successful. Further, it is not possible to rotate the telescoping liners and therefore the cementing process is not as efficient as it could be. Thus, there is a critical need for a liner hanger which is capable of supporting heavy loads and yet is rotational, while allowing release of the setting tool and drill pipe prior to commencing cementing operations.

The present invention provides a unique series of cooperating liner hangers which distribute the load on the bearings proportionately among the individual hangers. Each hanger assembly is located a selected distance away from the others, as required by stress analysis for each individual job, and each is set into position separately within the well casing. A unique sealed bearing arrangement on each of the hangers provides rotational capability. The sealed bearings are automatically pressure balanced to euqalize internal bearing pressure and external ambient pressure at any given well depth. Since the bearings are sealed they are protected from the erosive well environment. Further, each bearing is sandwiched between soft metal layers which, in effect, cushion the bearing raceway and thus help to prevent breaking when a heavy side pressure is exerted on the raceway. Hence, the present invention achieves the need for a rotational, distributed load, liner hanger having a balanced pressure sealed bearing.

SUMMARY OF THE INVENTION

This distributed load liner hanger assembly utilizes several hanger units which are positioned downhole and affixed to well casing over a selected distance thereof. The hangers are set individually, either mechanically or hydraulically, and are spaced apart from each other to distribute the load over a given distance of the casing upon which the hangers are set. The top portion of each hanger is rotational, separated from the lower stationary portion of the hanger by a sealed bearing arrangement. A rotational conduit, which is suspended through each of the hangers, is threadably secured to the rotational top portion of each hanger and a casing liner is attached to the lower end of the conduit. Once the hanger assembly is completely set, surface equipment is used to rotate the drill pipe which imparts rotational motion during cementing operations to the suspended casing liner.

DETAILED DESCRIPTION OF THE DRAWINGS

Figure 1:
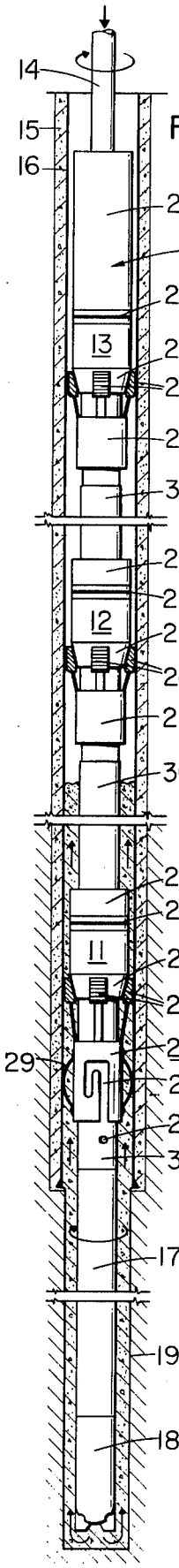
FIG. 1 is a cross-sectional view of the liner hanger assembly and the suspended casing liner.

Referring to FIG. 1 there is shown generally, a liner hanger assembly 10 provided with three individual hanger units, 11, 12 and 13. The liner hanger assembly is shown as it is suspended from and affixed to well pipe or casing 16, which has previously been cemented into the well bore 15. Hanging from the lower end of the liner hanger assembly 10 is well pipe or casing liner 17 with attached cement shoe 18 at its lowermost end. The casing liner is suspended in the lower well bore 19.

Figure 3:
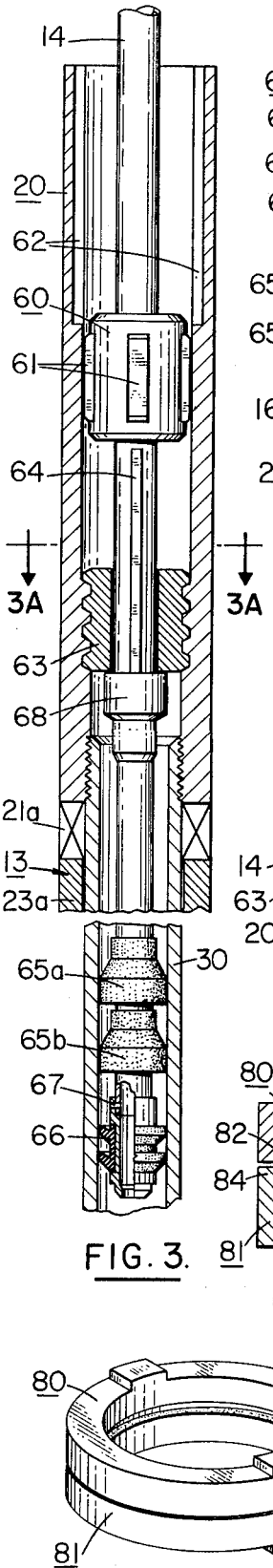
FIG. 3 is a cross-sectional view of the rotatable receiver housing as shown in FIG. 1.

At the upper end of the first hanger unit 13 is a rotational receiver housing 20 into which is releasably attached drill pipe 14, as seen in FIG. 3, which extends upward to the surface. The receiver housing 20 rests on sealed bearing **21*a* which is attached to a fixed hanger cone 23*a*. The hanger cone 23*a* is affixed to the casing 16 by a hydraulically operated sleeve 25*a* which has two or more hanger slips 24*a* surrounding it which when set are securely wedged between the casing 16 and the hanger cone 23*a*. Extending through the fixed hanger unit 13 is a rotatable conduit 30 which is threadably secured to the rotational receiver housing 20, as seen in FIG. 3, as the conduit rests upon and is partially supported by hanger 13 when that hanger is secured to casing 16**.

The second hanger unit 12 is the same as hanger unit 13 except that receiver housing 20 is replaced by a rotational sleeve **22*a* which is threadably engaged, not shown, to conduit 30 and rests upon sealed bearing 21*b* and is partially supported by hanger unit 12. The hanger 12 is fixed to casing 16 in the same manner as hanger 13 with hydraulically operated sleeve 25*b* moving upward to wedge slips 24*b* between casing 16 and hanger cone 23*b***.

The third hanger 11 is the first hanger affixed to casing 16 during assembly. Whereas hanger units 12 and 13 are set hydraulically, hanger unit 11 is set mechanically. Otherwise, hanger 11 is similar to hanger 12. J-slot sleeve 26 of hanger 11 has a J-slot 27 formed therein which is releasably engageable with lug 28 on rotational conduit 30. Attached to sleeve 26 are several drag springs 29 which are biased between sleeve 26 and casing 16. The basic design and operation of the individual hangers is standard, except for modifications and improvements hereinafter discussed. For further description of the hydraulic and mechanical actuation of hanger slips reference is made to Composite Catalog of Oil Field Equipment and Services, Vol. 3, pps. 4940–4942, (1974–1975), published by World Oil. Although in the preferred embodiment of the invention only two of the hanger units 12 and 13 are illustrated as being hydraulically actuated all of the hanger units may be so actuated.

Figure 2:
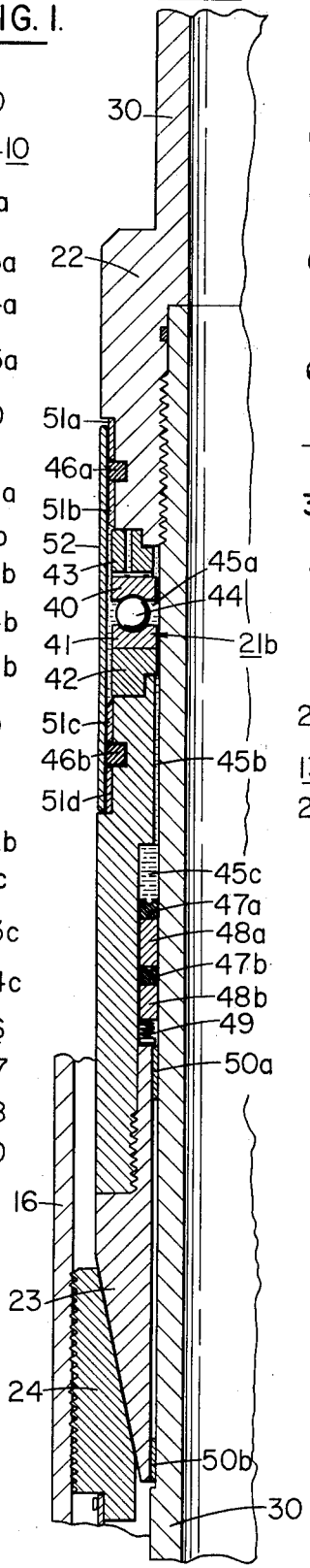
FIG. 2 is an enlarged cross-sectional view of the seal and bearing assembly of FIG. 1.
Figure 5A:
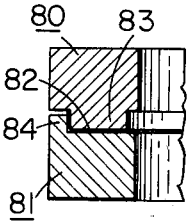
FIG. 5A is an enlarged fragmentary view of the device of FIG. 5.
Figure 5B:
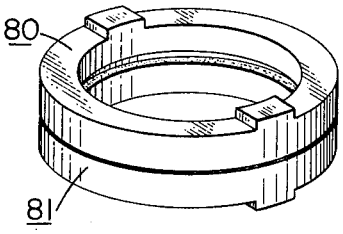
FIG. 5B is an isometric view of the journal bearing embodied in FIG. 5.
Figure 5:
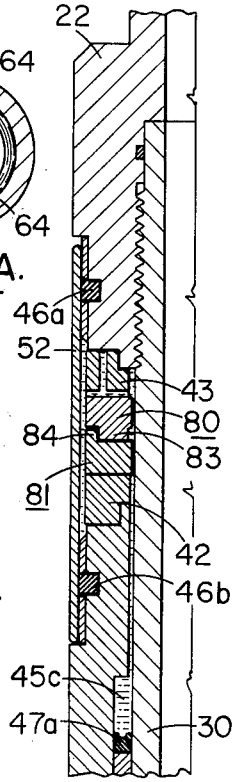
FIG. 5 is a cross-sectional view of a journal type bearing embodied in the seal and bearing assembly of FIG. 2.

Referring now to FIG. 2, rotational sleeve **22*a* is shown as it is threadably engaged with conduit 30 and resting upon sealed bearing arrangement 21*b*. In this embodiment, the sealed bearing arrangement 21*b* is defined as a roller ball bearing system. In FIG. 5, a sealed journal bearing arrangement is shown and would serve as well. In the ball bearing arrangement of FIG. 2, roller balls 44 are positioned in a sealed groove formed by upper race 40 and lower race 41. The bearing raceway, formed by upper and lower races 40 and 41, is sandwiched between an upper circular shoulder 43 and a lower circular shoulder 42 fabricated of a metal which is characteristically softer than the bearing raceway. The space 45*a* between the upper and lower races is filled with a lubricant, typically oil or grease. Annular spaces 45*b* and 45*c* formed therein are also filled with the same fluid and are interconnected. Closing annular space 45*c* is a seal 47*a* which rests upon a brass ring shim 48*a*. Another type seal 47*b* is positioned between brass shims 48*a* and 48*b*. At the lower end of shim 48*b* is a biasing spring 49. Separating the stationary hanger cone 23 and rotational conduit 30 are brass shims 50*a* and 50*b*. A thin seal sleeve 52 encloses the sealed bearing 21*b* and is set in a recessed segment of hanger cone 23 and rotating sleeve 22. Positioned between the seal sleeve 52 and rotational sleeve 22 are brass shims 51*a* and 51*b* separated by a seal 46*a*. Brass shims 51*c* and 51*d* and seal 46*b* separate the lower end of seal sleeve 52 from the hanger cone 23**. A similar sealed bearing arrangement, as depicted in FIG. 2, is employed by all individual hangers.

Figure 3A:
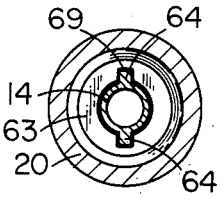
FIG. 3A is a cross-sectional top view of the interior of the receiver housing taken along line 3A—3A of FIG. 3.

Referring now to FIG. 3, a cross-sectional view of the rotational receiver housing 20, drill pipe 14 is shown with the removable receiver assembly as it is positioned in receiver housing 20. Attached to drill pipe 14 is a retractable rotating tool 60 having several spring-biased dogs 61. Beneath rotating tool 60 is a floating nut 63 resting on a shoulder 68 formed on drill pipe 14. Floating nut 63 is engageable with a threaded section of the interior of receiver housing 20. As depicted in FIG. 3A, floating nut 63 has a keyway 69 which is engageable with keys 64 on drill pipe 14. When rotated, nut 63 will "float" up and disengage from the threaded section of housing 20. In this condition, tool 60 can be retracted and the spring-biased dogs 61 will engage the splines 62 in the upper part of housing 20. At the lowermost end of housing 20 are several seal cups 65 which prevent cement from entering the upper end of housing 20. Attached to the lower end of the drill pipe 14 is a cement wiper plug 66 as it is connected by shear pin 67.

Figure 4:
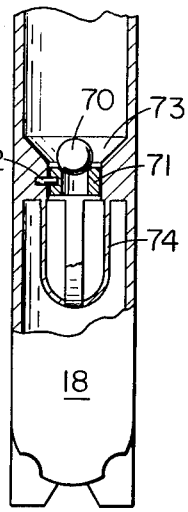
FIG. 4 is a cross-sectional view, parly in section, of a ball valve and cage assembly.

Referring now to FIG. 4, a cement shoe 18 is shown, partly in section, revealing a ball valve arrangement which provides a seal to allow pressurization of liner casing 17 which actuates hydraulically set hangers 12 and 13. The ball 70 rests on seat 71 which is shear pinned 72 to a constricted portion 73 of casing liner 17. A cage 74 is provided to receive the ball 70 and seat 71 when the valve assembly is no longer needed and to prevent plugging or fouling of the cement shoe orifices.

Referring now to FIG. 5, a sealed bearing assembly is shown embodying a journal type bearing. The journal type bearing is designed to be interchangeable with the ball type bearing of FIG. 2, and thus is shown in an identical sealed bearing assembly. Upper ring bearing plate 80 is shown as it is engaged with lower ring bearing plate 81. Upper bearing plate 80 is rotational on the stationary lower bearing plate 81. The interface 82 of the two bearing plates is fabricated of a resilient material with a low coefficient of friction, as shown in FIG. 5A. Such a material might be nylon or teflon and can be bonded, in any suitable manner, to either the upper plate or the lower plate or it can be bonded to both. The bearing plates have interlocking shoulders 83 and 84 to keep them in proper alignment during rotation of bearing plate 80.

Upper shoulder 43 and lower shoulder 42 are abutted to each of the bearing plates and, as with the ball bearing raceway arrangement, they are fabricated of a metal that is characteristically softer than that of the bearing plates. As stated previously, the function of these shoulders is to prevent heavy side pressure from cracking the bearing when the suspended casing liner is at an angle from the vertical. The remainder of the sealed journal bearing assembly is identical to the ball bearing assembly and is pressure balanced in the same manner. An isometric view of the journal bearing is shown in FIG. 5B for further description.

Figure 6:
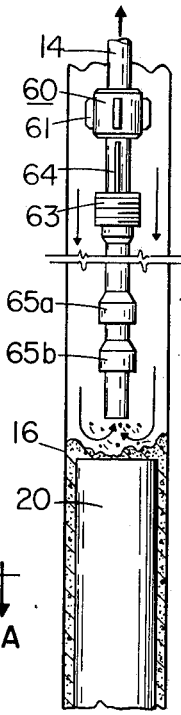
FIG. 6 is a cross-sectional view, partly in section, depicting removal of the setting tool assembly.

Referring now to FIG. 6, the setting tool assembly is shown as it is being picked straight up and out of rotational receiver housing 20, leaving the liner hanger assembly in place, once cementing operations have been completed.

Further description and explanation follows as a description of the operation of the invention.

OPERATION

The operation of the present invention involves several different steps. A liner hanger assembly 10 including conduit 30, and casing liner 17 are inserted into the borehole suspended on drill pipe 14 from the drilling rig. The upper casing 16 has been previously cemented into position and will form the support from which the casing liner 17 will thereafter be suspended. Once so suspended, the weight of the casing liner 17 will be distributed evenly over the several hangers as they are attached to and supported by the casing 16. Although the number of hangers is not critical, the use of three hangers had been demonstrated to be effective in tests with long and heavy liners. As more hangers are used, it becomes much more difficult in setting each hanger to ensure that it carries a proportionate amount of the full suspended weight. Further, using a greater number of hangers requires much more operating time. Thus, this discussion of the operation will assume the use of three hanger units.

The hanger 11 which is lowermost on the conduit pipe 30 is positioned first. When suspended in the well bore the entire weight of the liner hanger assembly 10 and the casing liner 17, to be set, is supported by the drill pipe 14, through nut 63 and shoulder 68. At this point, due to the great weight suspended, the nut 63 is not disengageable from the threaded bore section of housing 20 by rotation of the drill pipe.

When liner hanger assembly 10 reaches the desired depth in the borehole, sleeve 26 of hanger 11 is restrained against vertical and rotational movement by drag springs 19. Assembly 10 and casing liner 17 are then lifted and rotated in sleeve 26 and then lowered to free the lugh 28 from J-slot 27 before the cone **23*c* forces the slips 24*c* outwardly to set them into position. This allows free rotation of conduit 30 in sleeve 26. Hanger assembly 10 and casing liner 17 are then lowered until the hanger slips 24*c* are wedged securely between the surface casing 16 and the hanger cone 23*c*. The hanger unit 11 is now set and is securely locked into position. At this time, or while setting hanger unit 11, a heavy ball 70 is dropped from the surface through the open ended drill pipe 14, conduit 30, and casing liner 17, into ball valve seat 71 of FIG. 4. This is to form a seal to allow hydraulic pressurization within the bore of the hanger assembly 10. Varied sequential pressurization of the liner is the method used to separately set the middle and upper hangers 12 and 13. The lower hanger slip sleeve of each hanger is shear pinned to conduit 30** (not shown) and the pins are designed to shear at different pressures.

With the first hanger set into position, its share of the distributive load is placed on it. By way of example, and for simplicity, the total weight of the entire string is assumed to be 300,000 pounds therefore approximately 100,000 is placed on the first hanger, and 200,000 pounds remains supported from the surface. Surface hoisting equipment is used to support the structure and a standard weight indicator is used to accurately measure the suspended weight supported at the surface. At this time the bore of the assembly 10, and particularly that of hanger unit 12, is pressurized, to a predetermined value to shear a pin (not shown) restraining movement of hydraulic sleeve **25*b* to force hydraulic sleeve 25*b* upwards to engage hanger slips 24*b* securely between the casing 16 Assembly 10 and casing liner 17 are then lifted and rotated in sleeve 26 and the lowered to free the lug 28 from J-slot 27 before the cone 23*c* forces the slips 24*c* outwardly to set them into position. This allows free rotation of conduit 30 in sleeve 26. Hanger assembly 10 and casing liner 17 are then lowered until the hanger slips 24*c* are wedged securely between the surface casing 16 and the hanger cone 23*c*. The hanger unit 11 is now set and is securely locked into position. At this time, or while setting hanger unit 11, a heavy ball 70 is dropped from the surface through the open ended drill pipe 14, conduit 30, and casing liner 17, into ball valve seat 71 of FIG. 4. This is to form a seal to allow hydraulic pressurization within the bore of the hanger assembly 10. Varied sequential pressurization of the liner is the method used to separately set the middle and upper hangers 12 and 13. The lower hanger slip sleeve of each hanger is shear pinned to conduit 30** (not shown) and the pins are designed to shear at different pressures.

With the first hanger set into position, its share of the distributive load is placed on it. By way of example, and for simplicity, the total weight of the entire string is assumed to be 300,000 pounds therefore approximately 100,000 is placed on the first hanger, and 200,000 pounds remains supported from the surface. Surface hoisting equipment is used to support the structure and a standard weight indicator is used to accurately measure the suspended weight supported at the surface. At this time the bore of the assembly 10, and particularly that of hanger unit 12, is pressurized, to a predetermined value to shear a pin (not shown) restraining movement of hydraulic sleeve **25*b* to force hydraulic sleeve 25***b* upwards to engage hangers slips 24*b* securely between the casing 16 and hanger cone 23*b*. Positioning of the second hanger is now complete. At this time, 100,000 pounds is set on the second hanger by letting down on drill pipe 14 until the surface weight indicator reads 100,000. Once this is done the weight is distributed approximately as follows: 100,000 pounds is carried by hanger 11, 100,000 pounds is carried by hanger 12, no appreciable weight is carried by hanger 13, and 100,000 pounds is still supported by the drill pipe from the rig at the surface. Finally, the third hanger is set by the same procedure used for hanger 12 except that a higher pressure is required to shear the pin of the third hanger. The surface weight indicator is backed down to a zero liner weight reading thus placing the remaining 100,000 pounds on the third hanger 13. At this point each hanger is carrying a proportionate amount of the total distributed load; viz approximately 100,000 pounds apiece.

The preceding discussion is a simplified outline of the procedure resulting in an approximately equal weight distribution. However, compensation is required to readjust the distributed load to achieve a more exact distribution due to linear displacement of conduit 30 each time weight is placed on a set hanger. That is, when weight is set on the middle hanger 12 for example, some of the weight is redistributed down to the lower hanger 11 as a result of linear displacement of the conduit 30. In evaluating the load distribution procedure, a hanger displacement versus load test was performed. The test was conducted by placing the subject hanger in a section of casing, engaging the hanger slips using 300 psi of hydraulic pressure, and axially loading the hanger with a hydraulic press while measuring displacement of the central conduit of the hanger with respect to the 7-⅝ inch casing used in the test. Again, the test was necessary in evaluating the procedure because if load is to be lifted off a set hanger and loaded on hanger slips up the hole, any strain occurring between load holding points will redistribute load downhole, i.e., if the upper slips give way or if the conduit moves downward with respect to the casing in which the liner is set as load is set on the hanger, then load is passed on to lower fixed points. The results of this test indicated that very little movement occurs after the slips are set hydraulically. Maximum displacement with a load of 34,000 pounds was 0.039 inches. For a typical 5", 18 pound liner with a 40' joint between hangers, pulling an additional 10,000 pounds of load above the desired distributive load will induce a stretch between hangers equal to 0.039 inches, so that once the hanger is set, load compensation for the predicted movement will provide a highly accurate weight distribution. It should also be mentioned that the amount of movement downward, or linear displacement, is a function of the area of the hanger slips, the entire suspended weight to be set on a hanger, and the metallurgical characteristics of the casing against which the hanger slips are wedged. Further test results of load versus displacement are given below in Table I. Hence by compensating for the exact amount of load redistributed downhole, an almost exact distribution of weight can be made over the several hangers.

TABLE I

| Load (Pounds) | Displacement (Inches) |
|---|---|
| 11,300 | 0.02344 |
| 22,600 | 0.03125 |
| 34,000 | 0.03906 |

TABLE I-continued

| Load (Pounds) | Displacement (Inches) |
|---|---|
| 45,200 | 0.04688 |
| 56,500 | 0.05469 |
| 67,850 | 0.06250 |
| 79,170 | 0.06641 |

The hangers were designed not only to provide distributed load but also to facilitate rotation of the casing linear during cementing by incorporating a balanced pressure, sealed bearing arrangement on each hanger. Two types of bearings are herein described, a ball bearing and a journal bearing, but other bearings such as roller bearings could function as well. The importance is not in the specific type of bearing device employed but in the fact that the bearing is a balanced pressure, sealed bearing device. The importance of this type of bearing in oil and gas well operation is apparent when consideration is given to the type of environment in which they must function, that is, elevated pressures and erosive well fluids. Prior art bearings on single hangers were not sealed and therefore were exposed to erosive sand, etc. in well fluids and hence they would wear rapidly and fail often. Using an ordinary sealed bearing, however, was not in itself entirely satisfactory. At the great depths in the well bore in which these hangers are set, the bearings are subjected to elevated pressures necessitating some means to balance the internal pressure of a sealed bearing with the external, ambient pressure in the well bore.

FIG. 2 shows a ball bearing embodiment of the balanced pressure, sealed bearing arrangement and will serve as a model for explanation of the operation. The balls 44 are positioned in the bearing raceway found by upper and lower races 40 and 41. The space 45*a* around the ball is filled with oil or grease as are the connected annular spaces 45*b* and 45*c*. The bearing is enclosed by seal sleeve 52 and lower seals 47*a* and 47*b*. As the external ambient pressure increases with greater bore depth achieved, the lower brass shims 48*a* and 48*b* and the seals 47*a* and 47*b* are forced upwards until the internal pressure in the bearing is equal to the ambient pressure. The surface areas of seals 47*a* and 47*b* are equal to provide for a 1:1 pressure ratio across the seals. Spaces 45*a*, 45*b* and 45*c* are thus maintained at ambient hydrostatic pressure, and no pressure differential exists across the seals 47*a* and 47*b* or across seal sleeve 52. Spring 49 serves to maintain and allow filling of spaces 45*a*, 45*b* and 45*c* with oil so that air may be eliminated from the spaces during filling operations and allow for volume expansion of the oil due to heating. Thus, balanced pressure is maintained, automatically, at any depth.

Having described the operation of the pressure bearing assembly, the operation of the bearing in relation to the rotation of the liner hanger assembly 10 will now be described. As indicated, rotational conduit 30 is threadably engaged through rotational receiver housing 20 and rotational sleeves 22*a* and 22*b*. The rotational receiver housing 20 and sleeves 22*a* and 22*b* rest upon each of the sealed bearings. The lower races of each bearing are stationary hanger cones. As the upper receiver housing 20 is rotated, the lower rotational sleeves are simultaneously turned as is the conduit 30 which, again, is threadably engaged to and carried by the rotational sleeves on each of the hangers. The rotating conduit thus turns the suspended casing liner attached to it.

Before rotation of the shaft and cementing operations can commence, as shown in FIG. 3, the floating nut 63 in the receiver housing 20 must be disengaged and the rotating tool 60 with spring-biased dogs 61 must be engaged in splines 62 of housing 20. Since all the weight is supported by hanger assembly 10, no weight stress is on floating nut 63, and it is easily rotated to disengage it from the threads. Once this is completed, tool 60, which is attached to the drill pipe 14, is retracted to engage the splines of housing 20. With the tool securely in position, the rotation of drill pipe 14 is imparted to housing 20 which in turn rotates the conduit 30 and casing liner 17. Since temperature changes occur in the drill string during cementing operations, the drill string will usually shorten due to cooling. To ensure that the dogs are not retracted from the splines, approximately 1,000 pounds of weight can be set on the tool. This weight is maintained during cementing by keeping the surface weight constant.

At this time, cement is introduced at the surface and passes through the center of the drill pipe 14, conduit 30, and casing liner 17 and out the cement shoe 18 at the bottom of the well bore 19. As more cement is introduced, it is forced back up the well bore 19 on the exterior of the casing liner 17. During the cementing operation the casing liner 17 is constantly rotated to ensure a thorough application of cement and complete displacement of the drilling mud. Once the cementing is completed, as shown in FIG. 6, the setting tool assembly, i.e., the rotating tool 60, floating nut 63, and seal cups 65*a* and 65*b*, are picked up out of the rotational housing 20 leaving the hanger assembly 10 and casing liner 17 in place. Further well operations can now commence.

It will be apparent that various changes and modifications in the illustrative embodiments of the invention, shown and described herein, can be made without departing from the scope of the invention as defined in the appended claims.

What is claimed is:

1. A balanced pressure, sealed bearing apparatus, comprising:
   a. a plurality of balls;
   b. an upper hard metallic race;
   c. a lower hard metallic race;
   d. an upper shoulder abutting said upper race fabricated of a metal which is softer than said upper race;
   e. a lower shoulder abutting said lower race fabricated of a metal which is softer than said lower race;
   f. a seal sleeve closing off and defining a space for sealing lubricant about the interior of said bearing, and
   g. a lower seal assembly having a plurality of movable seals which are pressure responsive to balance internal bearing pressure with the ambient external pressure.

2. The sealed bearing of claim 1 in which said lower seal assembly includes a plurality of spaced apart seals separated by shim sleeves and includes a biasing spring engageable with a hanger cone.

3. The sealed bearing of claim 1 in which the interior of said bearing is packed with a heat resistant lubricant.

4. A balanced pressure, sealed bearing apparatus, comprising:
   a. an upper annular ring bearing plate having a shoulder engageable with a
   b. lower annular ring bearing plate, the interface surfaces of the upper and lower bearing plates being formed of a resilient material having a low coefficient of friction;
   c. an upper shoulder abutting said upper bearing plate fabricated of a metal softer than that of said upper bearing plate;
   d. A lower shoulder abutting said lower bearing plate fabricated of a metal softer than that of said lower bearing plate;
   e. a seal sleeve closing off and defining a space for sealing lubricant about the interior of said bearing; and
   f. a lower seal assembly having a plurality of movable seals which are pressure responsive to balance internal bearing pressure with the external ambient well bore pressure.

5. The sealed bearing of claim 4 in which said lower seal assembly includes a plurality of spaced apart seals separated by shim sleeves and includes a biasing spring engageable with a hanger cone.

6. The sealed bearing of claim 4 in which the interior of said bearing is packed with a heat resistant lubricant.

* * * * *